United States Patent [19]

Adams et al.

[11] Patent Number: 4,831,410

[45] Date of Patent: May 16, 1989

[54] AUTOMATIC EXPOSURE CONTROL SYSTEM FOR FLASH EXPOSURE PHOTOCOPIERS

[75] Inventors: Jerry F. Adams, Webster; Michael D. Borton, Ontario; Fred F. Hubble, III, Rochester; James P. Martin, Rochester; Ralph A. Shoemaker, Rochester; Alan J. Werner, Rochester, all of N.Y.; Virginia N. MacDonald, Carrollton, Tex.

[73] Assignee: Xerox Corporation, Stamford, Conn.

[21] Appl. No.: 146,660

[22] Filed: Jan. 21, 1988

[51] Int. Cl.[4] ..... G03G 15/00

[52] U.S. Cl. ..... 355/208; 355/67; 355/68; 355/14 R; 355/14 D; 355/214; 355/246; 340/641

[58] Field of Search ..... 355/14 E, 14 R, 11, 355/67, 68, 69, 70; 356/222, 219; 340/517, 518, 600, 641, 642

[56] References Cited

U.S. PATENT DOCUMENTS

| | | | |
|---|---|---|---|
| 3,877,413 | 4/1975 | Rowell et al. | 118/7 |
| 3,995,950 | 12/1976 | Townsend | 355/3 |
| 4,017,180 | 4/1977 | Yen et al. | 355/68 |
| 4,153,364 | 5/1979 | Suzuki et al. | 355/14 |
| 4,200,391 | 4/1980 | Sakamoto et al. | 355/14 |
| 4,334,767 | 6/1982 | Lehman | 355/68 |
| 4,354,758 | 10/1982 | Futaki | 355/14 E |
| 4,372,674 | 2/1983 | Yukawa et al. | 355/14 D |
| 4,624,547 | 11/1986 | Endo et al. | 355/14 E |
| 4,785,328 | 11/1988 | Tanimoto et al. | 355/14 R |
| 4,794,422 | 12/1988 | Lehman et al. | 355/14 E |
| 4,796,065 | 1/1989 | Kanbayashi | 355/14 E |

*Primary Examiner*—A. C. Prescott

[57] ABSTRACT

A flash exposure photocopier provides a mechanism for automatically controlling photoreceptor exposure levels to compensate for the effects of documents having backgrounds of different densities. A photosensor and lens assembly is located within a flash housing in a position whereby a large portion of the document is imaged by the lens onto the surface of a chip having a plurality of individual photosensors contained thereon. The outputs of each photosensor are integrated and applied to a comparator set at a particular reference level. The comparator output controls the duration of the flash source so as to quench lamp operation when an input level is reached corresponding to the particular reference level set. The integrated photosensor outputs are also summed and a signal representing their average value is compared to the signal which triggers the comparator. The ratio of these signals is used to identify documents with high area coverage and hence high toner usage. The toner dispensing rate is then regulated accordingly.

4 Claims, 9 Drawing Sheets

AUTOMATIC EXPOSURE CONTROL SYSTEM FOR FLASH EXPOSURE PHOTOCOPIERS

BACKGROUND AND INFORMATION DISCLOSURE STATEMENT

This invention relates to a flash exposure photocopying machine and, more particularly, to an automated system for controlling photoreceptor exposure in response to detection of original documents of varying color backgrounds.

In electrophotographic devices, such as a xerographic copier or printer, a photoconductive surface is charged to a substantially uniform potential. The charged portion of the photoconductive surface is exposed to a light image of an original document being reproduced, forming an electrostatic latent image at the photoconductive surface corresponding to the informational areas contained within the original document. The electrostatic latent image is subsequently developed by bringing a developer mixture into contact therewith. The developed image is then transferred to an output copy sheet and the powder image on the output sheet is heated to permanently affix the image to the sheet.

The documents that are copied may vary considerably in the actinic density of the paper substrate. White documents may have absolute densities that range from 0.04 to 0.20 depending on factors such as quality and age. Documents with colored backgrounds may have phototopic densities as high as 0.50. Copiers without compensation tend to produce unacceptable background when copying colored background documents. Various compensating techniques, know as background suppression or background stabilization, are implemented to reduce the undesirable side effect of solid-area sensitivity. For example, it is known to provide manual background stabilization in the form of a range of copy-lighter/copy-darker settings on the control panel of a copier. The high background from a colored original is suppressed by selecting a copy/lighter mode which typically increases exposure, or developer bias, or a combination of the two. This technique has the disadvantage of being a hit or miss technique and causes considerable delays in the copying operation until suitable settings are found for the particular document.

It is also known to provide various forms of automatic background stabilization. For example, the Minolta 350 copier uses a passive developer-bias control that increases bias when the average image potential increases. The 3M "Sensitron" copier increases exposure when the average reflectance across the process decreases. This technique compensates for variations in substrate density for low-area-coverage documents but, undesirably, also compensate for areas of high image density, mistaking the image density for background density. Another example of an automatic background stabilization technique is that found in the Canon NP-270F copier. For this technique, the scanning system performs a prescan of the document, sensing the background image potential with a built-in electrometer. Exposure is then adjusted prior to the actual exposure scan. This technique is also disclosed in U.S. Pat. No. 4,200,391. The disadvantage in this type of correction is undesirable loss of productivity due to the extra time required for the process.

Other background sensing circuits for scan-type systems are disclosed in U.S. Pat. Nos. 4,153,364 and 4,372,674. In U.S. Pat. No. 4,153,364, a scanning linear photosensor array detects maximum and mdinimum output levels of a light image incident thereon and uses the information to control the illumination intensity of the document and the developing bias voltage. U.S. Pat. No. 4,372,674 discloses a copying machine having detectors for the background color and density of an original document and having means for generating a bias voltage based on these measurements.

Another technique to automatically stabilize background is to sense the charge level of an exposed image by an electrometer positioned between the exposure and developer stations and to adjust the developer bias to compensate for changing background levels. Representative of this technique is the disclosure in U.S. Pat. No. 3,877,413 and co-pending application 901,990, assigned to the same assignee as the present invention.

Compensation techniques for flash exposure systems have tended to be costly and/or limited to function. U.S. Pat. No. 3,877,413 cited above discloses a flash system, but requires that the developer bias be changed. It would be desirable for a flash type system to regulate the lamp exposure so as to to provide the exact component of exposure required by the particular background of the document being copied. U.S. Pat. No. 4,334,767 discloses such a system in which a lens/sensor placed in the floor of a flash lamp housing generates a real time signal which is integrated and used to control the flash lamp exposure time. This mechanism is suitable for some systems, but provides only a rough approximation of the document background since the sensor output includes a mixture of foreground and background information.

It would be desirable to utilize an exposure control system with improved discrimination between background and foreground density of the original. The present invention is directed toward an exposure control system which utilizes a photosensor with a plurality of photosites, each photosite sensitive to the background of a discrete portion of the document being copied. Photocurrent outputs from the photosites are integrated to determine the lowest background density. A representative signal of the density is used to quench the flash at the point of optimum exposure. More particularly, the invention relates to a flash exposure document imaging system wherein a document is flash-illuminated and an image projected by a lens within the housing onto the surface of a photoreceptor and includes an automatic exposure control mechanism comprising: a sensor array having a plurality of sensor elements therein, said array located within said housing at a location such that an image of the document is projected onto said array coincident with said flash illumination, circuit means for integrating photocurrents produced by each of said plurality of photosensors, comparator means for receiving the integrated outputs and for comparing the outputs with established reference levels, and circuit means for quenching said flash means as a function of the comparator output.

DESCRIPTION OF THE INVENTION

Figure 1:
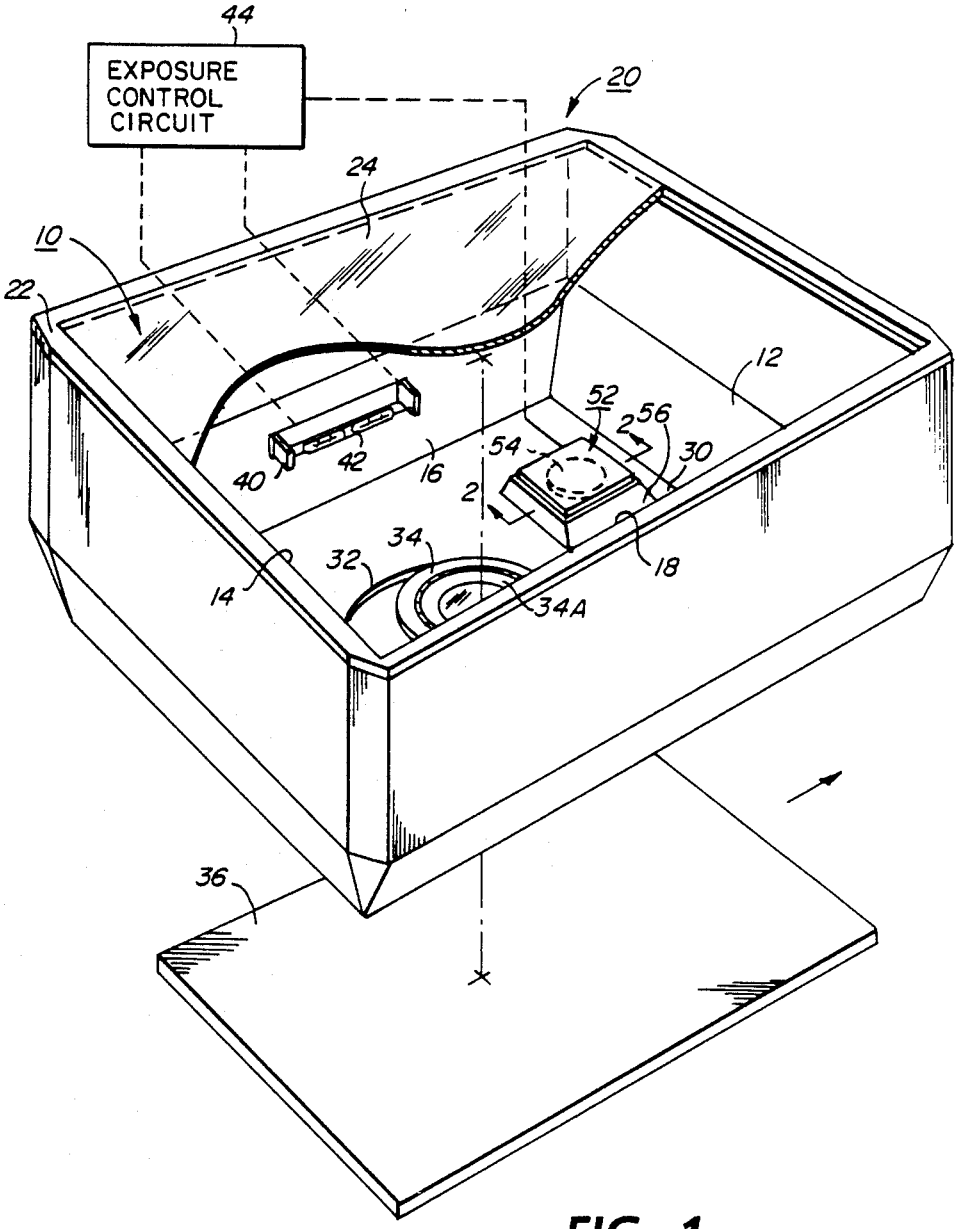
FIG. 1 is a perspective view of a flash illumination housing in which the control circuit of the present invention is utilized.

Referring now to FIG. 1, there is shown one embodiment of an integrating optical cavity containing a flash exposure lamp, a lens housing, and an automatic control sensing mechanism.

A completely enclosed housing 10, generally rectangular in shape, has a first pair of opposing side walls 12, 14 and a second pair of opposing side walls 16, 18. An upper, or top wall 20 includes a rectangular aperture 22 which, at the center thereof, accommodates a glass platen 24 forming the object plane. The floor, or bottom wall 30, has an aperture 32 therein which accommodates a circular lens housing 34. A photoreceptor 36, shown as a portion of a flat belt, to which a charge has been applied, is positioned for exposure to light reflected from a document on platen 24 and transmitted by lens 34. The projected light image selectively discharges the photoreceptor resulting in formation of a latent electrostatic image thereon. The image can be developed and transferred to an output media and fixed thereon using xerographic steps which are well known in the art. One example of an imaging system disclosing xerographic stations associated with flash exposure of a document is disclosed in U.S. Pat. No. 3,995,950, whose contents are hereby incorporated by reference.

Mounted in the lower half of side wall 16 by bracket 40 is flash illumination source 42. Source 42 in an embodiment is a lamp consisting of an envelope containing Xenon gas and a pair of electrodes at each end. The lamp is connected to exposure control circuit 44, described in detail below. When the lamp is activated, it undergoes a gas breakdown resulting in a flash of some duration. In operation, the lamp is periodically energized in a print mode in timed relation to the movement of the photoreceptor.

The interior walls of the cavity (12, 14, 16, 18, and 30) have substantially diffuse reflecting surfaces resulting from coating the interior wall surfaces with a high reflectivity (90%) material. Barrel 34*a* of lens housing 34 is similarly coated. The surfaces of the platen may be coated if desired with an anti-reflection material such as $M_gF_2$ or a multi-layer antireflective material. As is well known in the art, this material will prevent any platen-derived specular reflection from entering the lens.

Figure 2:
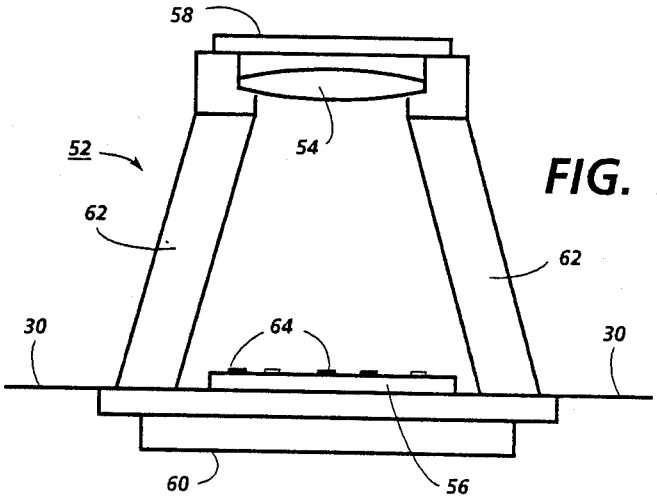
FIG. 2 is a side view of the sensor mechanism of the present invention.
Figure 3:
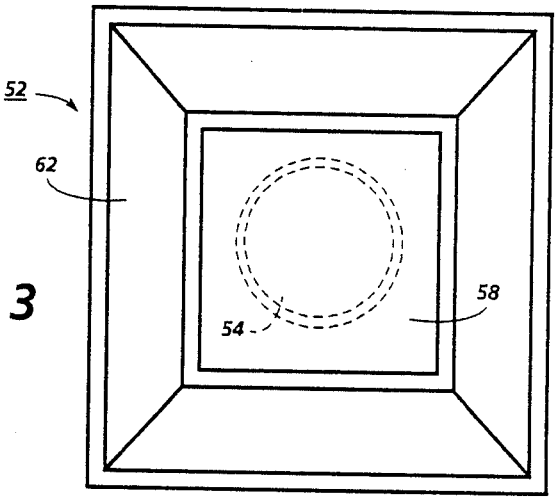
FIG. 3 is a top view of the sensor mechanism of FIG. 2.
Figure 4:
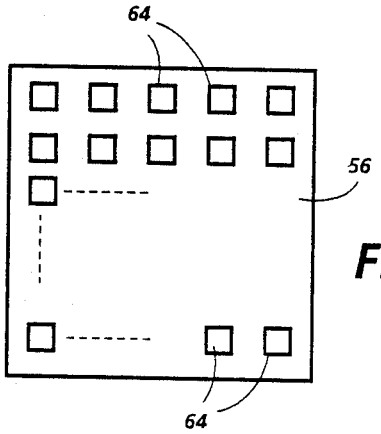
FIG. 4 is a top view of the integrated circuit chip showing the location and spacing of the photosites formed on the chip.

Continuing with the description, a background and area coverage sensor assembly 52 is mounted on the floor of cavity 10 adjacent lens 34. As shown in side view in FIG. 2, and top view in FIG. 3, sensor assembly 52 comprises a lens 54 which focuses light reflected from the entire document onto a photodetectorchip 56. The lens incorporates an actinic filter 58 selected to match the spectral response of the photodetector to that of the photoreceptor 36. Connector 60 provides electrical connection to control circuit 44. The lens and filter are mounted on a four-sided pyramidal support 62 and are thus positioned a fixed distance from chip 56. Photodetector chip 56, shown in a top, magnified view in FIG. 4, has a plurality of photosites 64 strategically located on the surface.

Connector 60 provides electrical connection between each photosite 64 and the control circuit 44. Circuit 44, as shown in block diagram form in FIG. 5, includes an integrating circuit 70 comprising a plurality of amplifier/integrators 72. The output of circuit 70 is sent to a high signal select circuit 74 which produces two outputs 74, 75, output 74 being sent to summing amplifier 76 and output 75 to comparator 77. Output 75 is also sent to toner dispenser control circuit 78 and is compared with signal 81 for purposes discussed below. The output of comparator 77 is used to control the output of flash lamp power supply 80, which, in turn, controls the exposure time of lamp 42.

In operation, and assuming a document with a colored background is placed on the platen, an operator will press a PRINT or COPY button sending an electrical signal to a triggering circuit which ionizes the gas within lamp 42 lowering its resistance and allowing the energy stored in a capacitor bank in lamp power supply 80 to be discharged through the lamp producing a flash of light. The light is directed against the cavity walls and, after undergoing multiple reflections from the reflective interior surfaces, produces a uniform, diffuse illumination of the document. An image of the document is projected through lens 34 onto the charged surface of photoreceptor and begins to discharge the surface in accordance with the background and foreground document information. An image of the document is also projected by lens 54 onto the integrated circuit chip 56. Photosites 64 are thus illuminated with an irradiance proportional to the portion of the document being sampled. Each photosite produces its own local photocurrent which is fed to integrating circuit 70. If all amplifier/integrators 72 are zeroed at the start of the flash, then the output of each during the exposure is proportional to the photoreceptor exposure at that particular region of the document at that instant of time.

The outputs of the integrator 72 are sent to signal selector circuit 73 which selects the signal with the highest absolute value and sends the output to comparator 77. In one embodiment, comparator 77 is an NSC LM 311 integrated circuit. The threshold of comparator 77 is set to an appropriate level e.g. 4 volts for a 5 volt circuitry. The comparator will be set high to enable exposure to continue, and low to quench the flash. During exposure the first integrated photocurrent signal to attain 4 volts will trigger the comparator, causing it to generate a signal to the lamp power supply 80 thereby generating a signal quenching the flash. Presumably, photosites which are located in background regions will be the ones that cause quenching. With conventional black on white documents, the integration time will be shorter than that observed with colored or tinted media in direct proportion to photoreceptor exposure. Thus, if the circuitry is properly designed and calibrated, the document exposure required to trigger the comparator will be exactly that required to drive the photoreceptor below residual development potential. As long as one photosite lies in a background region, the sensor will suppress the development of background regions of the document. As will be apparent from the above, a higher reference level increases the time required to trigger the comparator, thus reducing the density of the developed image. Alternatively, lowering the reference decreases the flash duration thereby increasing the developed density.

Figure 5:
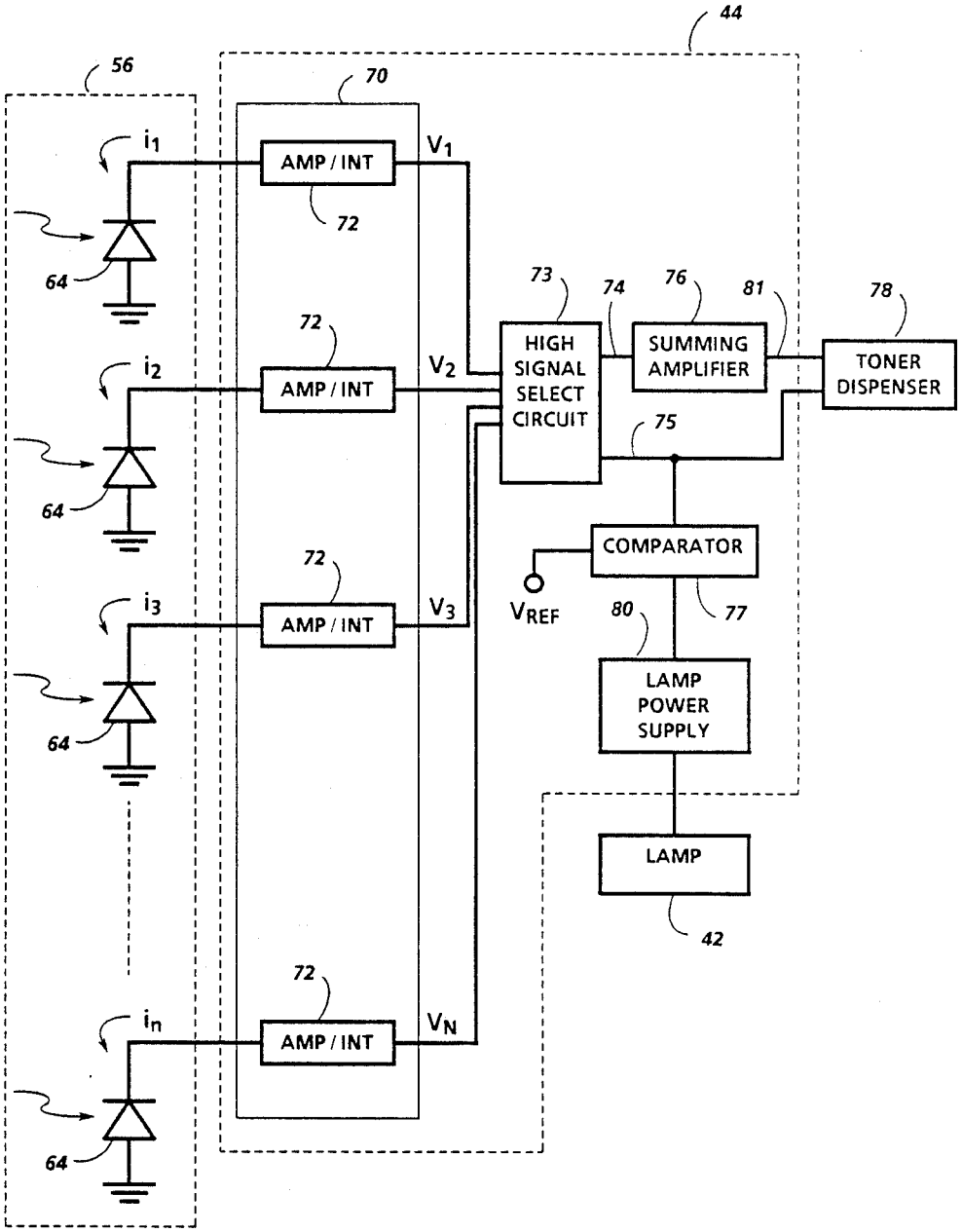
FIG. 5 shows an automatic exposure control circuit diagram.

According to another aspect of the invention, area coverage during copy runs can be measured and appropriate amounts of toner periodically added to the developer housing. Referring to FIG. 5, signal 74 from high signal select circuit 73 represents an average of the integrated amplifier outputs sent to summing amplifier 76. The output 81 from amplifier 76 represents the area coverage and is sent to toner dispenser control circuit 78. There the ratio of the signals 75 to 80 is compared. For documents with high area coverage this ratio will be low indicating that additional toner should be added. An appropriate signal is generated and sent to the toner dispensing mechanism to cause additional toner to be dispensed. Conversely, documents with low area coverage will drive this ratio toward unity because nearly all photosites will experience high irradiance and their respective integrator outputs will be near Vref when quench occurs.

Figure 6A:
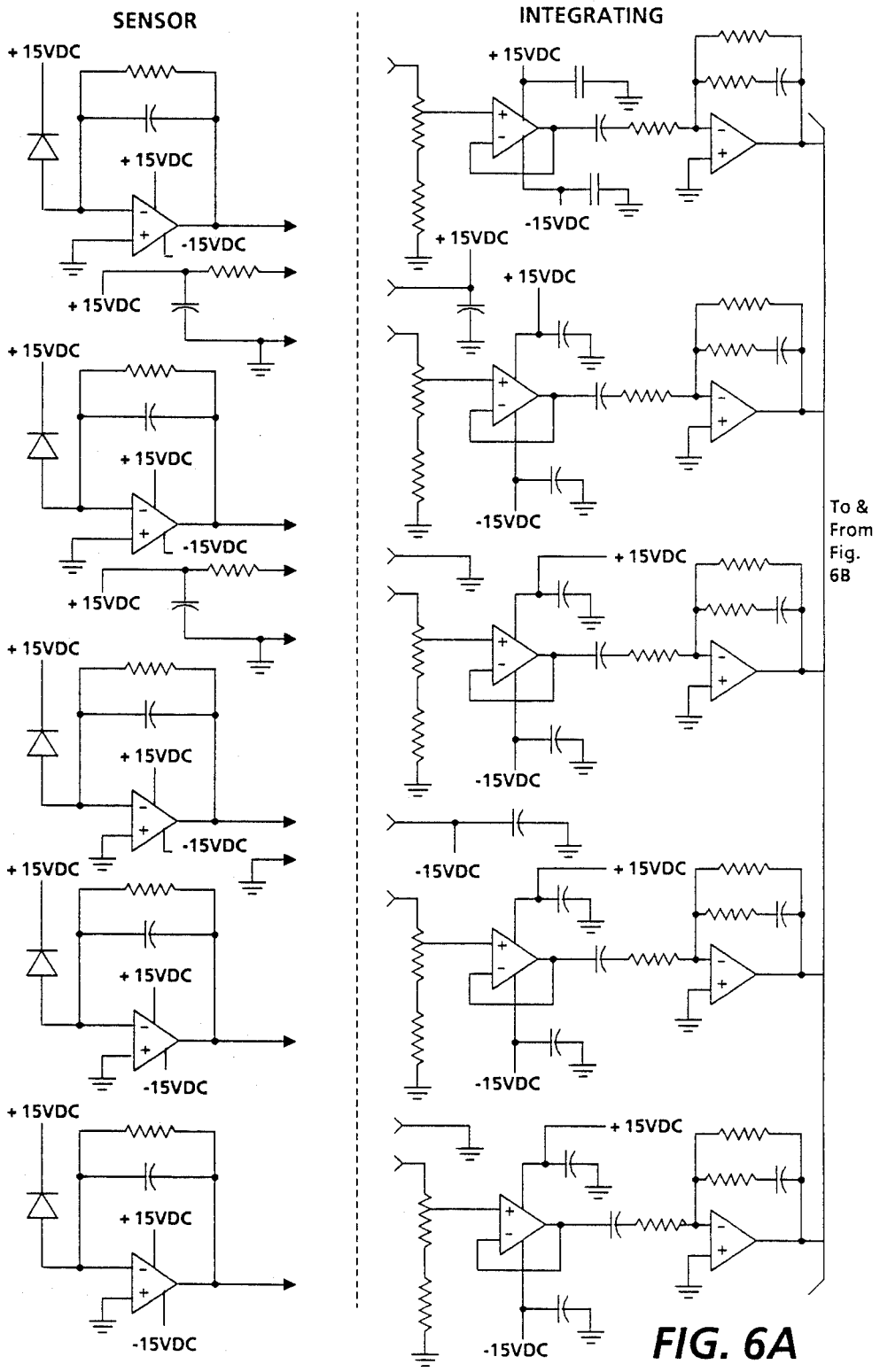
FIGS. 6A and 6B show a detailed schematic of a specific embodiment of the automatic control circuit.
Figure 6B:
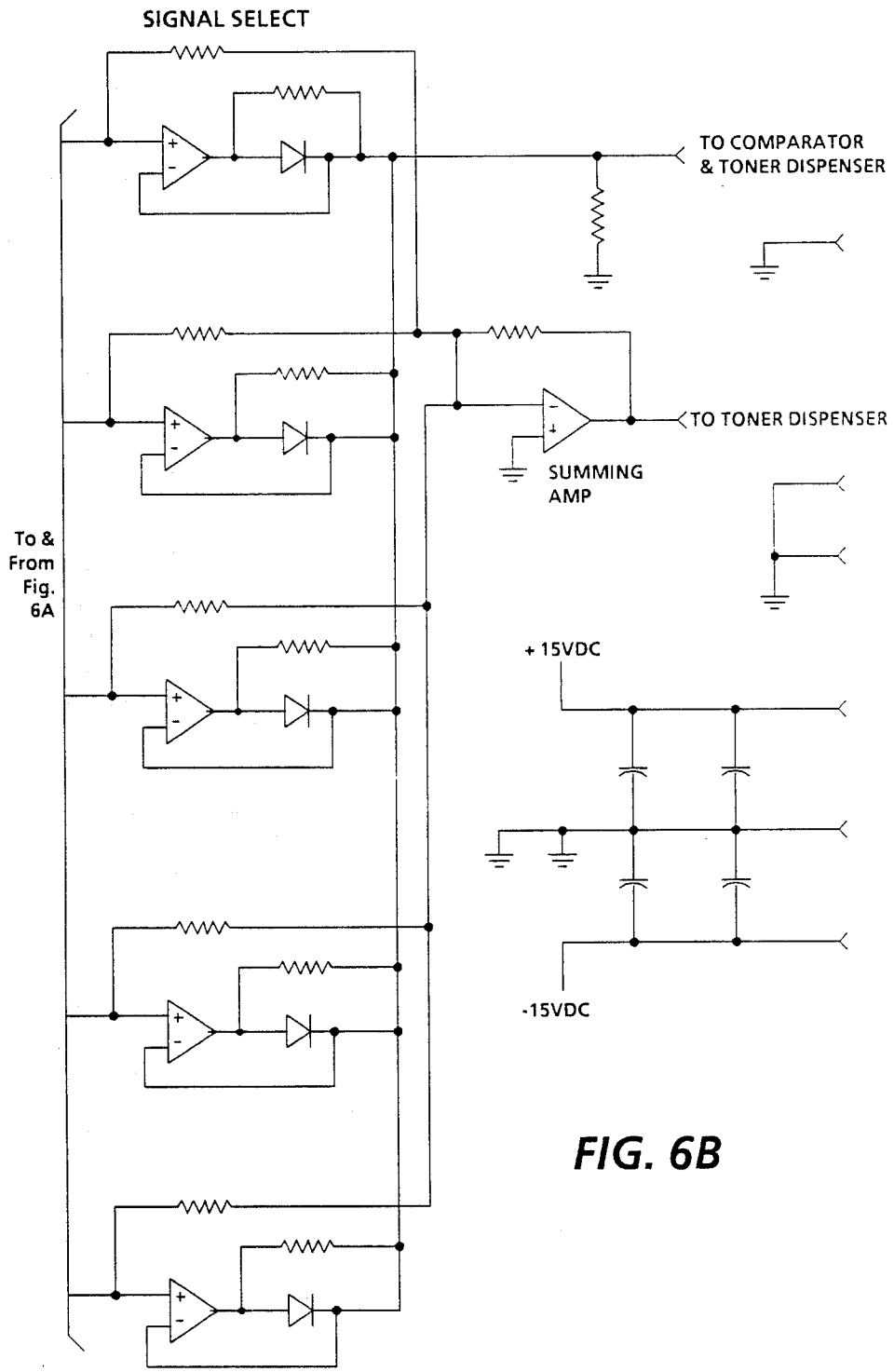

The automatic exposure control was tested using a standard PC board for chip 56 having five discrete OPC 910 1 mm diameter photodiodes thereon. Lens 54 was a 19 mm OD, 45 m fl biconvex lens. The lens was positioned 250 mm from the platen inside housing 10. Housing 10, power supply circuit 44 and lens 42 were part of a commercial Xerox 1090 machine. Flash exposure of a document produced a 45×60 mm inverted image of a 205×273 mm section of the document on the surface of board 56. With this optical configuration, each photosite was illuminated by flux radiating from a 4.5 mm diameter circle on the document. Lens 54 was mounted on an 18 mm OD clear aperture which, in turn was mounted to a four-sided pyramidal support 62. Support 62, fabricated of aluminum for electrical shielding, was mounted to board 56. The inside of support 62 was blackened to minimize reflections onto the photodetectors while the exterior was whitened to minimize interaction with the cavity. FIG. 6 shows the detailed control circuitry for this configuration and represents a specific implementation of the FIG. 5 circuit.

The circuit was constructed on a double sided printed wiring board designed for surface mount components. The photodiodes were placed on one side, precisely located to intercept the document areas of interest. The remainder of the sense head circuitry was constructed on the other side, including the input-output connector.

The signal conditioning and support circuitry of FIG. 6 was constructed on a wire wrap board. The basic circuit consists of an input buffer/scaling amplifier, an integrator, a high signal selector stage and a summing amplifier. The input buffer/scaling stage serves the purpose of providing a low impedance input for the integrator, a method of matching the outputs of the photodiodes and the ability to compensate for the $\cos^4$ factor. The high signal selector consists of an operational amplifier with a steering diode in its output. The amplifier with the highest input gains control of the common bus while the other amplifier outputs are driven to the negative rail. These circuits were duplicated five times, one for each photosite. The summing amplifier, which products the area coverage output, is common to all channels.

Figure 7:
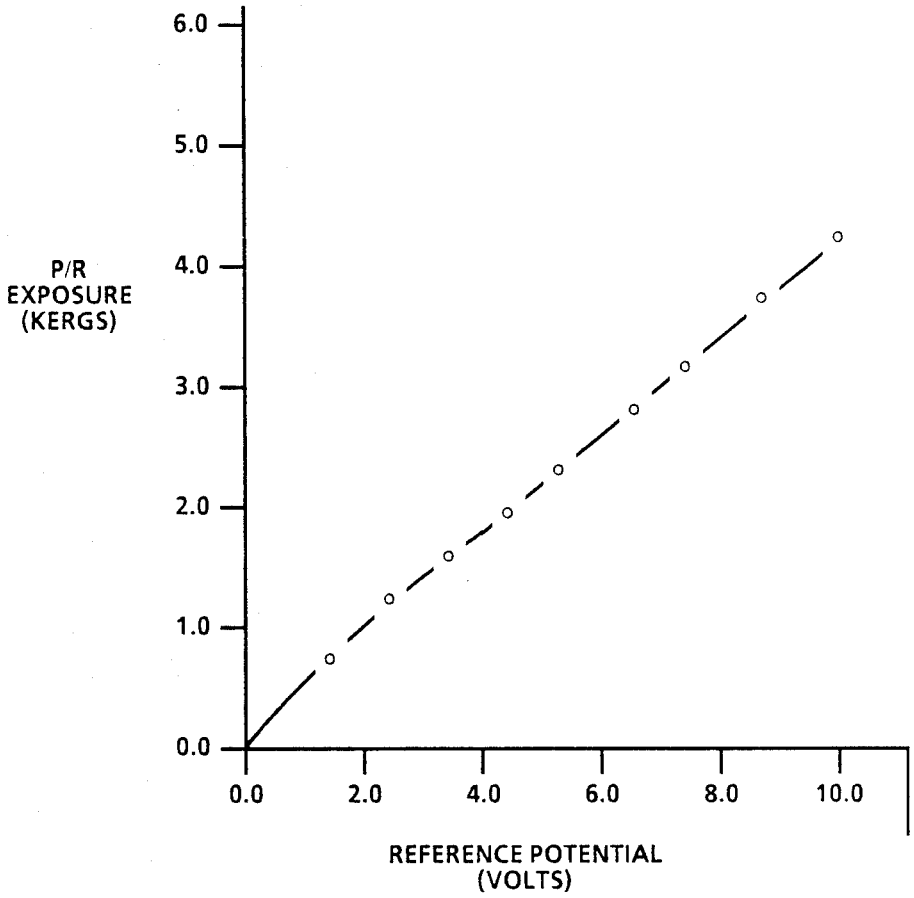
FIG. 7 is a plot of reference potential vs photoreceptor exposure.

The following set of tests were performed with a flash illumination cavity and power supply removed from a Xerox 1090 copier. A photoreceptor having the characteristics disclosed in U.S. Pat. No. 4,265,990 was used. Prior to testing, the platen glass was covered with white 32 pound card stock to simulate a closed platen. A 5×20 mm, UDT PIN photodiode with matching filter was positioned at the photoreceptor image location. The probe was connected to a UDT Model 81 Optometer and exposure at this location was recorded as a function of reference potential using the sensor 52. The results are shown in FIG. 7.

The following tests were, at a reference potential of approximately 4.5 volts to insure that the results would not be affected by limitations in power supply. This produced an exposure at the photoreceptor plane of around 2.0 kergs/cm$^2$ using white 4024 DP 8.5″×11″ blank paper at the image area of the platen.

To test background suppression, a selection of readily available colored papers was placed on the platen with a piece of 32 lb card stock behind to simulate a platen cover and the photoreceptor exposure and flash duration recorded during five sequences of ten flashes. As the test was designed solely to measure the ability of the sensor to properly expose background, the documents were all blank with no image information.

Figure 8:
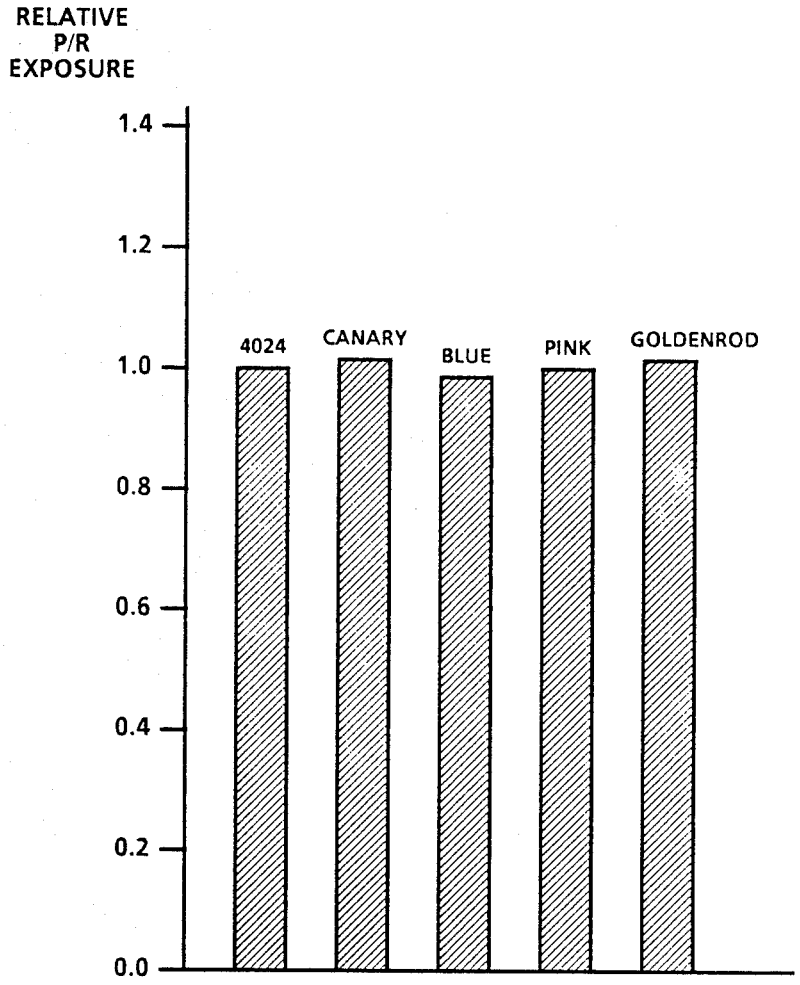
FIG. 8 is a plot comparing relative photoreceptor exposure using documents having different colored backgrounds.

FIG. 8 compares relative photoreceptor exposure using white 4024 DP, canary, blue, pink, and goldenrod backgrounds. In all cases the sensor 52 was able to hold the colored document exposure to within 4% of the white 4024.

Figure 9:
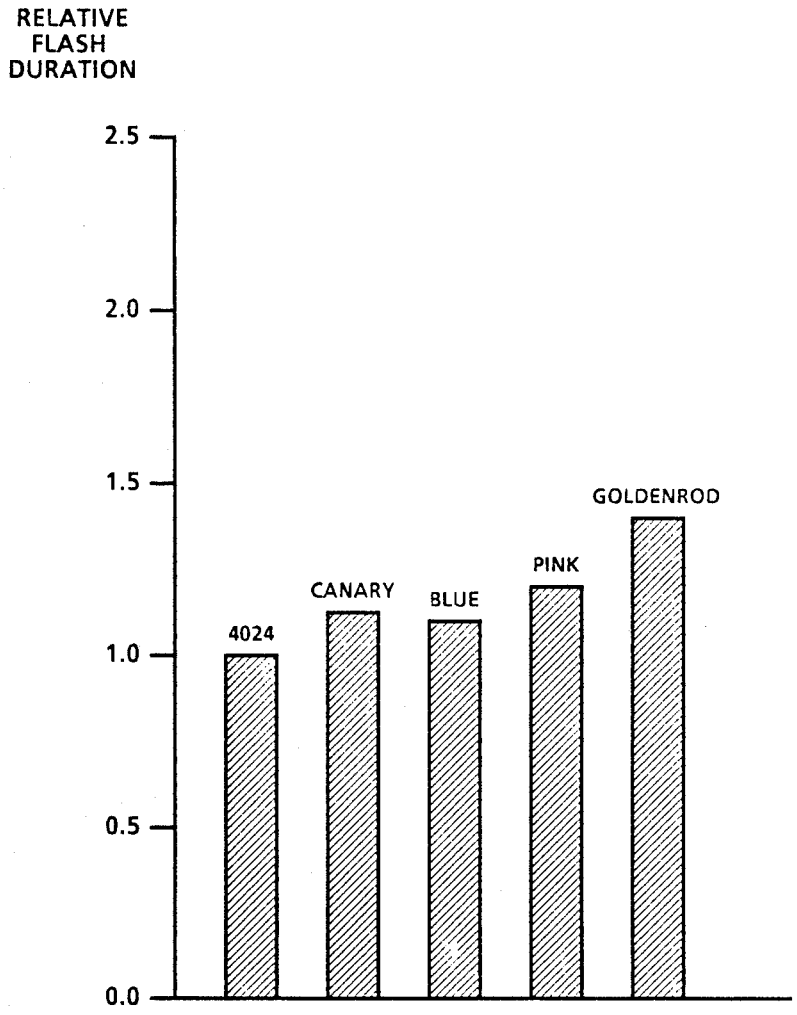
FIG. 9 is a plot comparing relative flash for documents with different colored backgrounds.

FIG. 9 displays the flash duration observed during the above tests. The sensor is shown to actually modulate the cavity flash, rising to 135% of the 4024 flash duration for goldenrod in maintaining constant photoreceptor exposure.

Area coverage was tested on white 4024 and on goldenrod paper. It is expected that results for the other document colors would fall between these two extremes. Originals were placed on the platen with 10, 20, 40, 60, and 80% area coverage, and the output of the sensor was recorded along with flash duration and photoreceptor background exposure.

Figure 10:
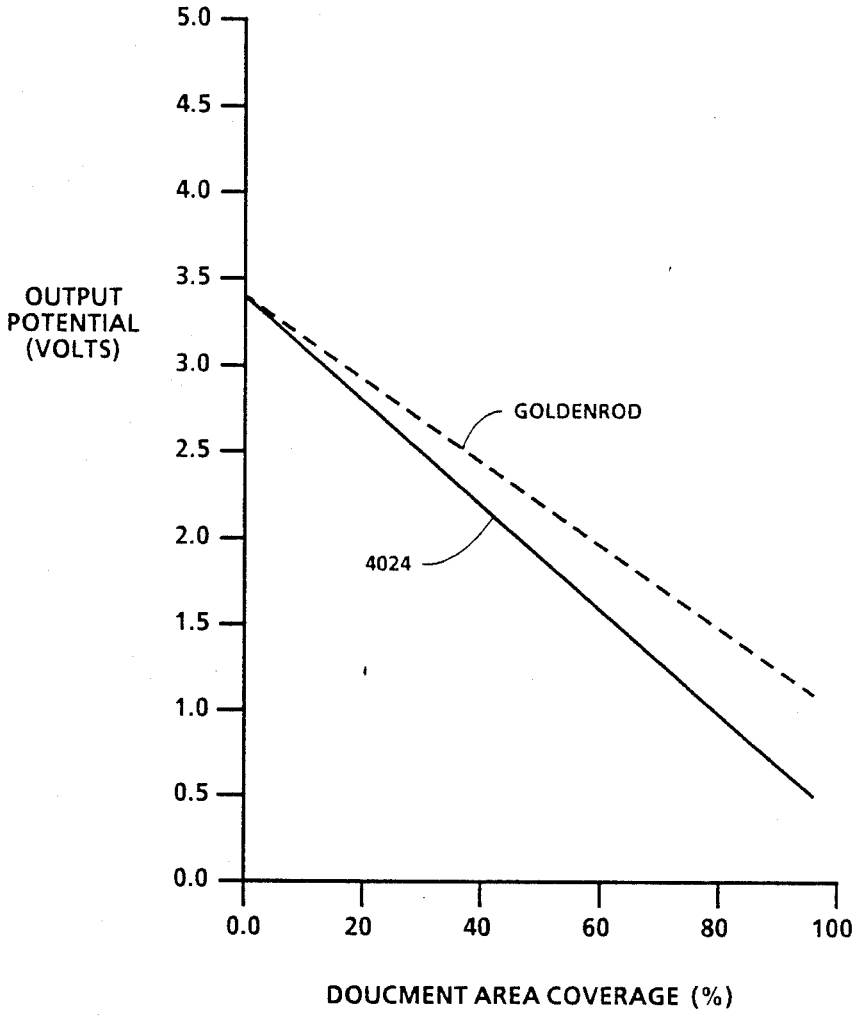
FIG. 10 is a plot of sensor output potential vs document area coverage.

FIG. 10 is a plot of the results. For both media, the output is a linear decreasing function of area coverage. The difference in the curves is from two sources. There is a small amount of flux inside the sense head whose origins stem from reflections off the platen cover and cavity walls. This flux is not attenuated by increased document area coverage and in the case of 4024 paper amounts to about 11% of the signal. Since flash duration is extended when goldenrod is substituted for white, this unattenuated "stray light" increases to around 15% of the signal. Additionally the image is lower in optical density relative to the substrate and, coupled with the extended flash, produces less attenuation of the average integrator output for a given coverage. The first factor, stray light, is a measurement error and should be minimized. The second replicates the photoreceptor behavior and is indeed a measure of decreased toner development for background corrected exposure.

The sensor 52 kept the photoreceptor exposure relatively constant during document irradiance, with flash duration rising around 2% for both papers at 80% area coverage. A 10% rise was observed using the 1090 sensor, which yielded an 8% rise in background exposure level.

Other advantages of the invention became apparent during the testing procedure. The sensor operation yielded more repeatable background exposure with paper of different degrees of "whiteness". The sensor also compensated for open platen copying more effectively and produced a low flash-to-flash variation when observing a single document.

While five photodiodes were sufficient to demonstrate feasibility, a larger number would probably be required for commercial use. The greater the number of sites, the smaller their size and the more optimally they are placed, the fewer documents that will be misread. Photosites and signal processing circuits could be combined on the same chip; alternatively, separation of photosites and circuits may be necessary if photo-induced carrier generation in the circuit requires. Separation would also enable a relatively large photosite to be fabricated in the empty space between the smaller sites, thus enabling a more accurate measure of area coverage.

Other changes and modifications may be possible consistent with the principles of the present invention. For example, although the sensor assembly was shown in FIG. 1 to be located on the floor of the housing, it could be at various other locations including the side walls. Suitable mirrors could be used to reflect light into the lens pupil at the required angle. All such changes are embraced by the following claims:

What is claimed is:

1. In a flash exposure document imaging system wherein a document on the surface of a light housing is flash-illuminated and an image projected by a lens within the housing onto the surface of a photoreceptor, an automatic exposure control mechanism comprising:

a sensor array having a plurality of sensor elements therein, said array located within said housing at a location such that an image of the document is projected onto said array coincident with said flash illumination, circuit means for integrating photocurrents produced by each of said plurality of photosensors, comparator means for receiving the integrated output and comparing the outputs with a reference level, and circuit means for quenching said flash means as a function of the comparator output.

2. The imaging system of claim 1 wherein said circuit means includes a plurality of amplifier/integrators connected to the output of said sensor elements and said comparator means is triggered by the first integrated photocurrent to attain said reference level.

3. The imaging system of claim 1 wherein a first lens mounted in the floor of the housing projects an image of the document onto the photoreceptor and further including a second lens which projects an image of the document onto said sensor array.

4. The imaging system of claim 1 further including summing means connected to the output of said integrating circuit means and a toner dispensing control circuit, said dispensing control circuit adapted to monitor the ratio of said integrated output and the output of the summing means and to generate toner dispensing signals when the ratio decreases to a specified value.

* * * * *